US008978175B2

(12) United States Patent
Bronstein

(10) Patent No.: US 8,978,175 B2
(45) Date of Patent: Mar. 17, 2015

(54) VARIABLE POSITION SHOWER APPARATUS AND RELATED METHODS

(76) Inventor: Edgar L. Bronstein, Caracas (VE)

( * ) Notice: Subject to any disclaimer, the term of this patent is extended or adjusted under 35 U.S.C. 154(b) by 448 days.

(21) Appl. No.: 13/472,612

(22) Filed: May 16, 2012

(65) Prior Publication Data

US 2012/0228408 A1 Sep. 13, 2012

Related U.S. Application Data

(63) Continuation-in-part of application No. 12/895,214, filed on Sep. 30, 2010, now abandoned, which is a continuation-in-part of application No. 12/827,721, filed on Jun. 30, 2010, now abandoned, which is a continuation-in-part of application No. 12/725,138, filed on Mar. 16, 2010, now Pat. No. 8,347,425.

(51) Int. Cl.
*A47K 3/022* (2006.01)
*E03C 1/06* (2006.01)

(52) U.S. Cl.
CPC ..... *E03C 1/066* (2013.01)
USPC ..... 4/601; 4/615

(58) Field of Classification Search
CPC ..... E03C 1/066
USPC ..... 4/601, 615
See application file for complete search history.

(56) References Cited

U.S. PATENT DOCUMENTS

| | | | | | |
|---|---|---|---|---|---|
| 4,171,094 | A | * | 10/1979 | Halfen | 239/752 |
| 4,177,927 | A | * | 12/1979 | Simmons | 239/102.1 |
| 4,274,400 | A | * | 6/1981 | Baus | 601/169 |
| 4,561,136 | A | | 12/1985 | Baer | |
| 4,872,225 | A | * | 10/1989 | Wagner | 4/662 |
| 6,148,453 | A | * | 11/2000 | Sartor | 4/615 |
| 6,390,433 | B1 | * | 5/2002 | Kasa-Djukic | 248/441.1 |
| 2003/0005514 | A1 | * | 1/2003 | Kunkel | 4/615 |
| 2005/0039252 | A1 | | 2/2005 | Fainberg | |
| 2005/0172396 | A1 | | 8/2005 | Marrs et al. | |

FOREIGN PATENT DOCUMENTS

| | | |
|---|---|---|
| JP | 3195523 | 8/1991 |

* cited by examiner

*Primary Examiner* — Janie Christiansen
(74) *Attorney, Agent, or Firm* — Allen, Dyer, Doppelt, Milbrath & Gilchrist

(57) ABSTRACT

The invention is directed to a shower assembly having an electronically controlled shower head that is controlled by a computerized control unit. The assembly can automatically bathe a user by following a program that dictates time of bathing, shower head position and motion, and the dispensing of bathing agents such as body wash or shampoo.

14 Claims, 4 Drawing Sheets

VARIABLE POSITION SHOWER APPARATUS AND RELATED METHODS

CROSS-REFERENCE TO RELATED APPLICATIONS

This is a Continuation-in-Part Application of U.S. application Ser. No. 12/895,214 filed Sep. 30, 2010 now abandoned entitled "Vertical Positioning Shower Attachment," which is a Continuation-in-Part Application of U.S. application Ser. No. 12/827,721 filed Jun. 30, 2010 now abandoned entitled "Self-Cleansing Automated Shower Attachment," which is a Continuation in Part Application of U.S. application Ser. No. 12/725,138 filed Mar. 16, 2010 now U.S. Pat. No. 8,347,425 entitled "Shower Attachment and Related Method of Use," the disclosures of which are herein incorporated by reference in their entirety all commonly owned.

FIELD OF THE INVENTION

This invention is directed to a shower attachment attachable to an existing shower enclosure for purposes of vertically positioning a shower head about a user to deliver, through automation, water and cleansing agents.

BACKGROUND OF THE INVENTION

The traditional showering apparatus primarily comprises a shower head and valves for regulating both the temperature and flow of the water through the shower head. Most advances in the field of showering relate to shower head designs that vary flow and spray settings to create various spray pulsations and patterns, often for the purpose of effectuating a massage. Other advances have included placement of multiple shower head arrays to create an envelope or cascade of water around a user. These additional shower heads are placed along the shower enclosure wall or on the ceiling of the shower. Many of these advances have focused, however, on the same fundamental shower system of a shower head and regulating valves.

Of course, showering remains a fundamental regimen for good personal hygiene. This is especially true and in hospitals, nursing homes, and assisted living facilities wherein cleanliness helps to prevent the spread of bacteria and viruses. It is often the case that individuals being treated at these facilities have infirmities that prevent them from showering without assistance. However, assistance when showering is not only potentially uncomfortable and embarrassing for the infirm individual, but requires a significant level of time and patience on the part of the assisting professional.

Very little has been done to create shower systems to assist infirm individuals who cannot stand upright to take a shower. Moreover, it is desirable to design a system to deliver a cleanser such as soap, shower gel, or similar agents.

Such systems could be employed to effectuate luxury and spa-like showering experiences. Current domestic shower systems optionally include a hand wand that is attached to the water regulating valves. A flexible tube attaches the hand wand to water-regulating valves so that the user has greater freedom to provide direct water pressure to various parts of the user's body. Optionally, these hand wands include settings to allow changes in pressure and water pattern. By engaging the hand wand, water is diverted from the shower head (typically located above the wand) and thus allows for a more spa-like feel.

Accordingly, there is a need in the art for a robust shower system designed to adapt to existing shower systems to allow infirm individuals to shower without need of assistance. Moreover, such an attachment should provide a complete shower to those infirm individuals with limited motor skills. Optionally, such attachment allows delivery, through automation, of cleaning agents to the infirm individual. In addition, there is a need in the art for domestic shower systems that provide automated and adjustable attachments for a spa like massage without the need for a manually operated wand. Preferably, such a device can be interchangeably used for both domestic and assisted living facilities in order to be mass-produced in a cost effective manner.

SUMMARY OF THE INVENTION

In view of the foregoing background, it is therefore an object of the present invention to provide an automated showering apparatus. The apparatus comprises a shower head, the position of which can be vertically adjusted by a motor. The motor changes the position of the shower head. The position of the shower head is constrained by a substantially rigid guide that defines a motion path of the shower head. A control unit having a microprocessor is in communication with the motor for the purpose of controlling the position of the shower head along the motion path. In one embodiment, a reservoir containing a bathing solution is in communication with the shower head, wherein the control unit controls the dispensing of a bathing solution from the reservoir through the shower head.

In one embodiment of the invention, a trolley having a first half and a second half is in communication with the motor. The trolley moves along the motion path, and the trolley is attached to the shower head so that as the trolley moves, the shower head also moves.

In another embodiment, the shower assembly comprises a leadscrew having a first end that rotatably communicates with a first plate and a second end that rotatably communicates with a second plate. The plates maintain the assembly. A guide rod having a first end that fixedly communicates with a first plate and a second end that fixedly communicates with a second plate is situated proximate and substantially parallel to the leadscrew. A nut having threads complimentary to the leadscrew engages the leadscrew to translate a rotary motion of the lead screw into a linear motion of the nut. The nut simultaneously engages the guide rod to prevent the nut from rotating about the leadscrew, wherein the nut travels along the length of the guide rod when the leadscrew rotates.

A first portion of the trolley is fixedly attached to the nut, wherein the first portion of the trolley comprises a first internal conduit, the first internal conduit comprising a first opening and a second opening. A second portion of the trolley comprises a second internal conduit, the second internal conduit comprising a first opening and a second opening, wherein the second portion of the trolley fixedly engages the first portion of the trolley, and the second opening of the first internal conduit of the first portion of the trolley communicates with the first opening of the second internal conduit of the second portion of the trolley, defining a first conduit junction. A shower head communicates with the second opening of the second internal conduit of the second portion of the trolley.

Water and bathing solutions enter into the various internal conduits so that both water and bathing solutions may exit the shower head to be dispensed on a bather.

BRIEF DESCRIPTION OF THE DRAWINGS

For a fuller understanding of the invention, reference is made to the following detailed description, taken in connection with the accompanying drawings illustrating various embodiments of the present invention, in which.

DETAILED DESCRIPTION OF THE PREFERRED EMBODIMENTS

In the Summary of the Invention above and in the Detailed Description of the Invention and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally. The term "comprises" is used herein to mean that other elements, steps, etc. are optionally present.

In this section, the present invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art.

The Overall Apparatus

Figure 1:
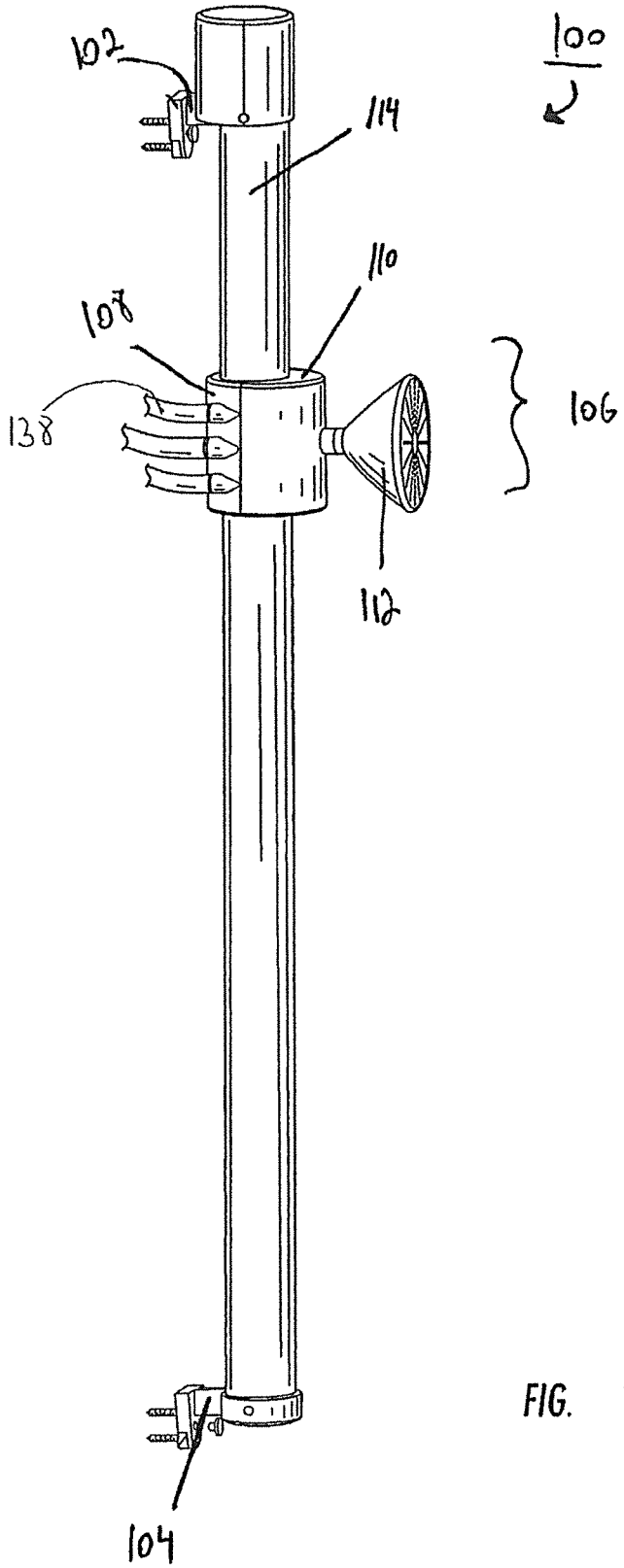
FIG. 1 is a perspective view of one embodiment of the invention.

Referring initially to FIG. 1, the overall apparatus taught by the invention relates to a shower attachment 100 which can be installed in an existing shower enclosure. In one contemplated use, the shower attachment 100 is used within a residence to aid in providing a total body cleansing. Such application can offer a spa-like experience by enveloping a user with a variety of angled jet sprays. In addition, the apparatus can alternatively be used to ensure proper cleansing of a child or other individual with sub-optimal motor function.

In a second contemplated use, the shower attachment 100 is used in a medical facility such as a hospital, nursing home, or assisted care facility to allow the elderly or infirm to shower in privacy, providing a reduced need for assistance and supervision by medical professionals. Such an application additionally decreases the spread of disease within such facilities, as it increases the ease and frequency of patient bathing. Other applications of the shower attachment 100 shall be known and understood by those of ordinary skill in the art upon review of the figures and disclosure contained herein.

Figure 2:
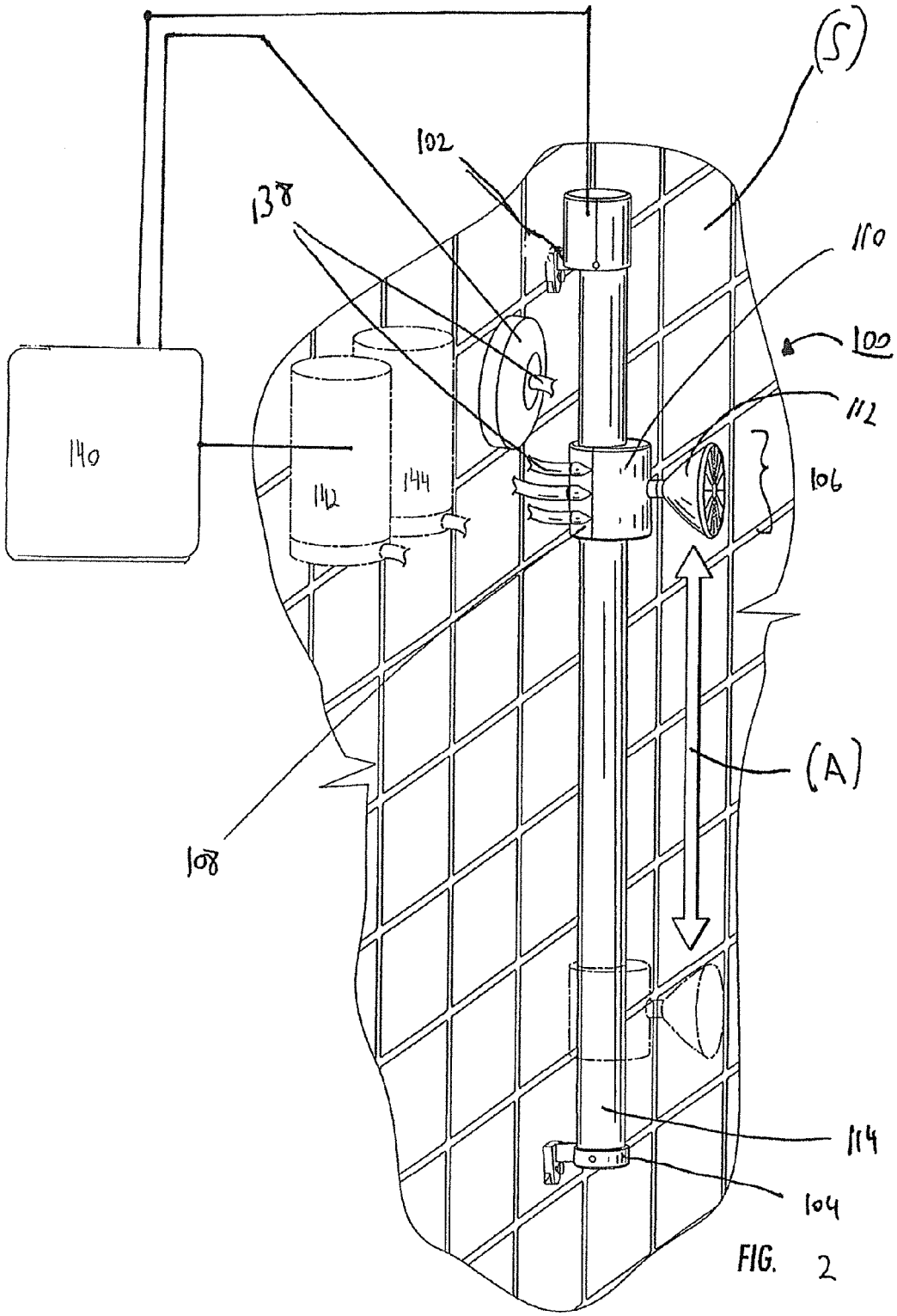
FIG. 2 is a perspective view of a like embodiment as illustrated in FIG. 1, that is installed on a substantially vertical surface.

FIG. 1 offers, by way of example a preferred embodiment of the shower attachment 100. The primary external components of the shower attachment 100, as illustrated, are a first plate 102 for the purpose of mounting the shower attachment to a mounting surface (S) (As illustrated in FIG. 2), a second plate 104 for the purpose of mounting the shower attachment to the mounting surface (S), a trolley 106 comprising at least a first portion of the trolley 108, a second portion of the trolley 110, and a shower head 112. A guide rod housing 114 communicates with at least one of the first plate 102 and the second plate 104. The guide rod housing 114 conceals the internal components (described in detail below) of the shower attachment 100 for safety and aesthetic purposes as well as for the purpose of protecting the internal components from the elements. The trolley 106 is a moveable unit that moves about the guide rod housing 114 to position the shower head 112 for bathing purposes.

The Actuation Mechanism

FIG. 2 illustrates the shower attachment 100 installed on a mounting surface (S). As illustrated by an arrow (A) in FIG. 2, the trolley 106 moves positions between the first plate 102 and the second plate 104.

Figure 3:
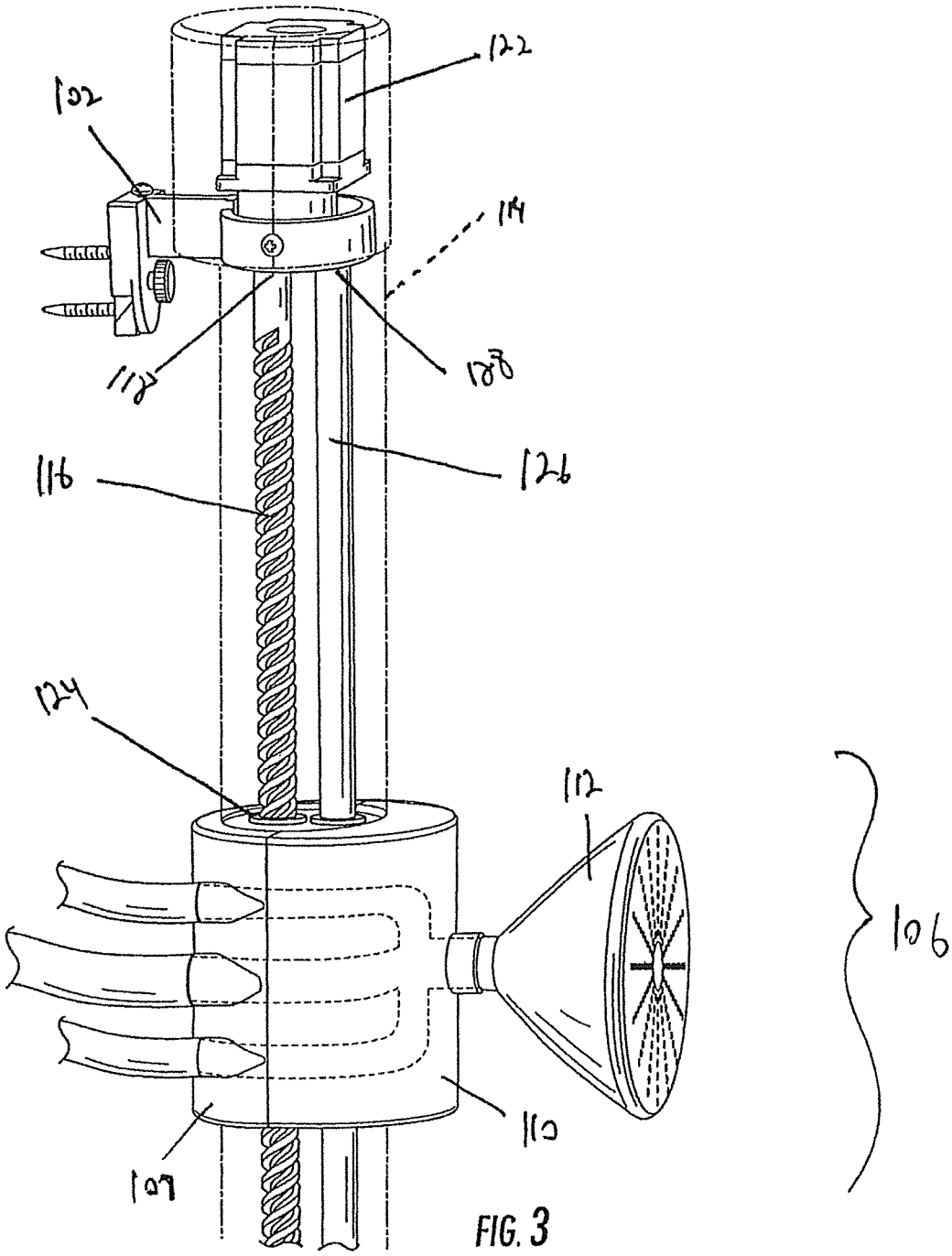
FIG. 3 is a cutaway perspective view of one embodiment of the invention.

FIG. 3 reveals some of the internal components of the trolley responsible for the motion of the trolley 106. A leadscrew 116 having a first end 118 and a second end 120 (FIG. 4) is in communication with the first plate 102 and the second plate 104. The leadscrew 116 rotates about its long axis. The leadscrew 116 is made of a metal, and comprises one of square threads, acme threads, buttress threads, or a helical bearing raceway. In a preferred embodiment the leadscrew is stainless steel 116 or any other non-corrosive material.

With continuing reference to FIG. 3, a motor 122 engages the first end 118 of the leadscrew 116 so that the motor 122 causes the leadscrew 116 to rotate. The motor 122 is one of an AC motor, brushed DC motor, brushless DC motor, printed armature DC motor, switched reluctance motor, or servo motor. In a preferred embodiment, the motor 122 is a stepping motor. The motor 122 also fixedly engages the first plate 102. At least one nut 124 engages the leadscrew 116, the nut 124 having threads that are complimentary to the leadscrew 116 threads. The nut 124 also communicates with a guide rod 126. The guide rod 126 is a smooth rod having a first end 128 and a second end 130 (FIG. 4), the first end 128 engaging the first plate 102, and the second end 130 engaging the second plate 104. The guide rod 126 is rigidly secured by the first and second plates 102, 104 using at least one of a mechanical fastener, pressure fit, thread, and adhesive. As the leadscrew 116 rotates, the nut 124 travels along the long access of the lead screw, effectively converting the rotational forces of the leadscrew 116 into a linear motion. The communication with the guide rod 126 prevents the nut 124 from merely spinning in place and also provides the nut 124 with a physical guide to follow so to create a linear motion path. Reversing the rotation of the leadscrew 116 reverses the direction of nut 124 travel.

The Trolley

Figure 4:
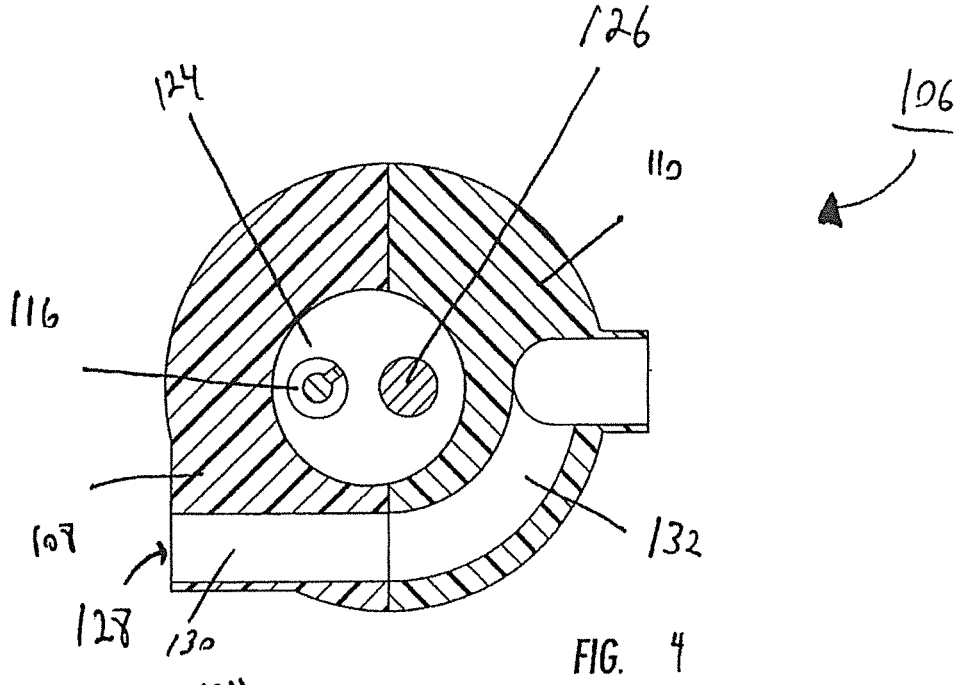
FIG. 4 is a top cutaway view of the trolley.

Referring now to FIG. 4, in a preferred embodiment the trolley 106 is of a multi-part construction. The first portion of the trolley 108 is affixed to the second portion of the trolley 110, and both portions 108, 110 fixedly engage the nut 124 that is in communication with the lead screw 116. As the nut 124 travels as a result of the leadscrew 116 turning, the attached trolley 106 travels with the nut 124.

Figure 5:
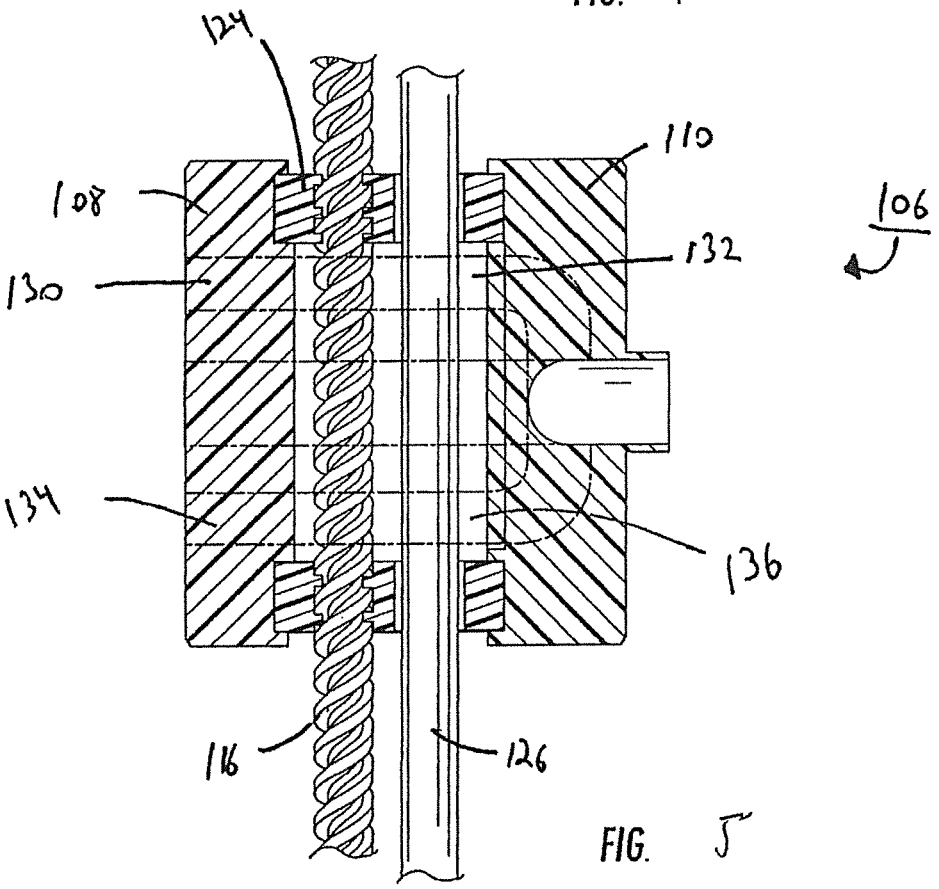
FIG. 5 is a side cutaway view of the trolley.

FIGS. 4 and 5 illustrate a first opening 128 of the first internal conduit 130 of the first portion of the trolley 108, wherein water introduced into the water supply line travels through the first internal conduit 130 of the first portion of the trolley 108 into a second internal conduit 132 of the second portion of the trolley 110 and exits through the shower head 112. The first internal conduit 130 meets the second internal conduit 132 at a first conduit junction 131.

FIG. 5 illustrates additional conduits of the trolley 106 that communicate with the shower head 112. A third internal conduit 134 of the first portion of the trolley 108 communicates with a fourth internal conduit 136 of the second portion of the trolley 110. The third internal conduit 134 meets the fourth internal conduit 136 at a second conduit junction (not shown). In one embodiment the trolley 106 comprises enough conduit routes to the shower head to deliver water, shampoo, body wash, conditioner, and any other solutions for known for use in bathing. In another embodiment, the third and fourth conduits 134, 136 serve to deliver shampoo, body wash, conditioner, and any other solutions for known for use in bathing. Solution reservoirs 142, 144 containing bathing solution communicate with the third and fourth conduits 134, 136.

With reference to FIG. 2, a water supply line 138 is sealedy connected to the first opening 128 of the first internal conduit 130 of the first portion of the trolley 108, wherein water introduced into the water supply line 138 travels through the first portion of the trolley 108 and second portion of the trolley 110 and exits through the shower head 112.

The trolley 106 is attached to the nut 124, so that when the leadscrew 116 turns, causing the nut to travel in a linear motion path, the trolley 106 moves along the same path, thus the shower head 112 can spray water or cleansing solutions at various height levels.

With reference again to FIG. 2, the motor 122 is electronically controlled, and in an embodiment communicates with a processor/microcontroller 140 (control unit). The processor/microcontroller 140 communicates with sensors and actuators for the purpose of controlling the trolley 106 height, the pressure and temperature of water leaving the shower head 112, the cleansing solution composition, and the sequence and timing of these apparatus features. Thus, cleaning routines may be programmed by a user or from the factory that wet, clean, and rinse a user automatically.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A shower assembly, comprising:

a leadscrew having a first end that rotatably communicates with a first plate and, the leadscrew having a second end that rotatably communicates with a second plate;

a guide rod having a first end that fixedly communicates with a first plate and, the guide rode having a second end that fixedly communicates with a second plate;

a nut having threads complimentary to the leadscrew that engages the leadscrew to translate a rotary motion of the lead screw into a linear motion of the nut, wherein the nut simultaneously engages the guide rod to prevent the nut from rotating about the leadscrew;

a first portion of a trolley is fixedly attached to the nut, wherein the first portion of the trolley comprises a first internal conduit, the first internal conduit comprising a first opening and a second opening;

a second portion of the trolley comprising a second internal conduit, the second internal conduit comprising a first opening and a second opening, wherein the second opening of the first internal conduit of the first portion of the trolley communicates with the first opening of the second internal conduit of the second portion of the trolley, defining a first conduit junction;

a shower head that communicates with the second opening of the second internal conduit of the second portion of the trolley;

a water supply line that is connected to the first opening of the first internal conduit of the first portion of the trolley, wherein water introduced into the water supply line travels through the first portion of the trolley and second portion of the trolley and exits through the shower head;

a motor that communicates with at one of the first end of the leadscrew and the second end of the lead screw, wherein the motor rotates the lead screw; and a guide rod housing having an interior side, and exterior side, a first end that engages the first plate, and a second end that engages the second plate, wherein the guide rod housing substantially encases the leadscrew, nut, and guide rod.

2. The invention of claim 1, wherein a gasket seals the junction between the first portion of the trolley and the second portion of the trolley for the purpose of sealing the first conduit junction and the second conduit junction.

3. The invention of claim 1, wherein:

the first plate communicates with a first bracket for the purposes of mounting the first plate to a vertical surface; and the second plate communicates with a second bracket for the purposes of mounting the second plate to a vertical surface.

4. The invention of claim 1, wherein a bushing attached to the nut encircles the guide rod, the bushing providing a low friction association between the nut and the guide rod.

5. The invention of claim 1, wherein the shower head comprises:

a plurality of spray jets; and an adjustment ring in communication with the spray jets for the purpose of altering a spray pattern of the spray jets.

6. The invention of claim 1, wherein:

the first portion of the trolley comprises a third internal conduit, the third internal conduit having a first opening and a second opening; and the second portion of the trolley comprises a fourth internal conduit, the fourth internal conduit having a first opening and a second opening, wherein the second opening of the third internal conduit of the first portion of the trolley communicates with the first opening of the fourth internal conduit of the second portion of the trolley, defining a second conduit junction; and the shower head communicates with the second opening of the fourth internal conduit of the second portion of the trolley, wherein a bathing agent introduced into the first opening of the third conduit of the first portion of the trolley travels through the third conduit to the fourth conduit and exits through the shower head.

7. The invention of claim 1, further comprising:

a user control unit for receiving user input;

a processing unit in communication with the user control unit and the motor to control the leadscrew;

a memory device in communication with the processing unit;

a power supply to supply power to the processing unit and the motor.

8. The invention of claim 7, further comprising a container in communication with the third conduit, the container being for the purpose of containing a cleaning agent.

9. The invention of claim 7, further comprising a display in communication with the processing unit.

10. The invention of claim 7, wherein the processing unit is programmed to automatically drive the leadscrew as part of a pre-programmed shower head travel sequence.

11. The invention of claim 7, further comprising a pump for the purpose of pumping the cleaning agent in the fluid container into the third conduit.

12. The invention of claim 7, wherein the display is a touch screen that receives user input.

13. The invention of claim 9, further comprising:

a user control unit for receiving user input;

a processing unit in communication with the pump;

a memory device in communication with the processing unit;

a power supply to supply power to the processing unit and the pump.

14. The invention of claim 13, wherein the processing unit is programmed to automatically release the cleaning agent as part of a pre-programmed sequence of user-chosen events.

* * * * *